US010844681B2

(12) United States Patent
Nester et al.

(10) Patent No.: US 10,844,681 B2
(45) Date of Patent: Nov. 24, 2020

(54) APPARATUS AND METHOD FOR CUTTING A TUBULAR

(71) Applicant: 2072677 ALBERTA LTD., Calgary (CA)

(72) Inventors: Travis Nester, Wardlow (CA); Shawn Lelek, Duchess (CA)

(73) Assignee: 2072677 ALBERTA LTD., Calgary (CA)

( * ) Notice: Subject to any disclaimer, the term of this patent is extended or adjusted under 35 U.S.C. 154(b) by 95 days.

(21) Appl. No.: 15/976,619

(22) Filed: May 10, 2018

(65) Prior Publication Data

US 2018/0363399 A1 Dec. 20, 2018

(30) Foreign Application Priority Data

Jun. 19, 2017 (CA) ..... 2971322

(51) Int. Cl.
*E21B 29/00* (2006.01)
*E21B 43/112* (2006.01)

(52) U.S. Cl.
CPC ..... *E21B 29/005* (2013.01)

(58) Field of Classification Search
CPC ..... E21B 7/046; E21B 43/11; E21B 43/112; E21B 29/002; E21B 29/005; E21B 29/06
USPC ..... 175/77, 78, 80, 81, 82
See application file for complete search history.

(56) References Cited

U.S. PATENT DOCUMENTS 3,797,576 A * 3/1974 Azalbert ..... E21B 4/00 166/299
4,007,797 A * 2/1977 Jeter ..... E21B 4/00 175/26
4,185,705 A * 1/1980 Bullard ..... E21B 4/16 175/78
5,746,279 A * 5/1998 Havlinek ..... E21B 7/061 175/52
7,478,982 B2 1/2009 Fuhst et al.
7,703,526 B2 * 4/2010 Fields ..... E21B 49/06 166/298

(Continued)

FOREIGN PATENT DOCUMENTS

AU 2010236947 10/2010
GB 341806 1/1931

OTHER PUBLICATIONS

Office Action issued in corresponding Australian Application No. 2017268491, dated Jan. 29, 2020.

*Primary Examiner* — Kenneth L Thompson
(74) *Attorney, Agent, or Firm* — Norton Rose Fulbright US LLP

(57) ABSTRACT

Embodiments of the present disclosure relate to a cutter tool for cutting tubulars from the inside thereof. The tubulars can be an oil well or a gas well, pipeline or other type of tubular. The cutter tool can include a housing that is insertable within the tubular and a cutting member that is receivable within the housing. The cutting member has a first end and a second end with the first end for cutting the tubular. The tool also includes a first shaft with a first shaft-end and a second shaft-end. The first shaft-end is releasably connectable to the housing. The tool also includes a second shaft that is connectable with the second end of the cutting member. The cutting member is moveable within the housing between a retracted position and an extended-and-cutting position by movement of the second shaft.

15 Claims, 11 Drawing Sheets

(56) References Cited

U.S. PATENT DOCUMENTS

| | | | | |
|---|---|---|---|---|
| 8,991,245 | B2 * | 3/2015 | Fields | E21B 7/061 73/152.41 |
| 9,441,436 | B2 | 9/2016 | Hallundbæk | |
| 10,316,602 | B2 * | 6/2019 | Andersen | B23C 3/00 |
| 2002/0023781 | A1 * | 2/2002 | Peters | C09K 8/72 175/67 |
| 2002/0150436 | A1 | 10/2002 | Mason et al. | |
| 2008/0236828 | A1 | 10/2008 | Fuhst et al. | |

* cited by examiner

FIG. 2A
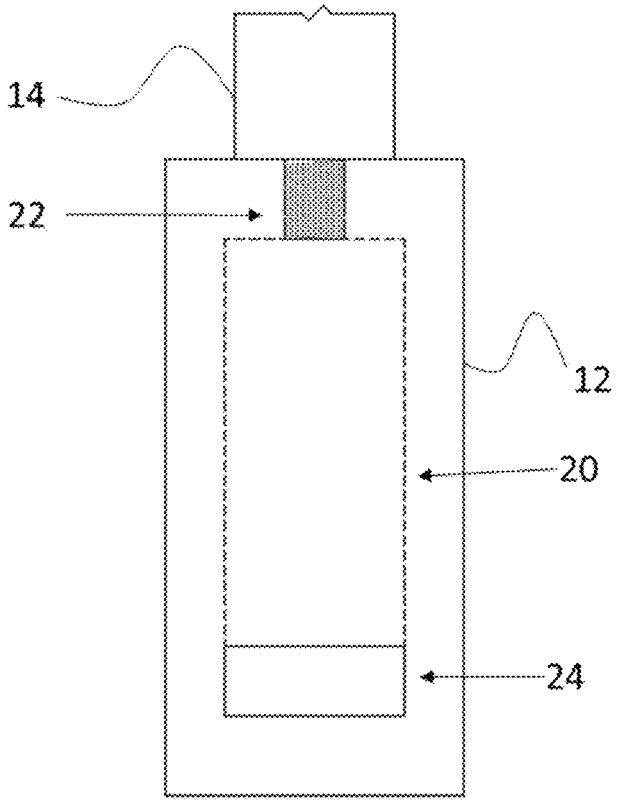
FIG. 2B
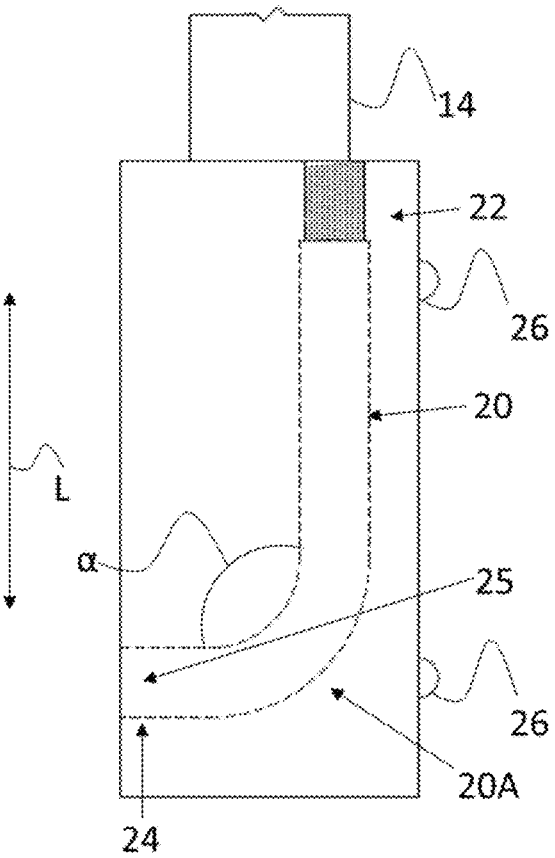
FIG. 2

FIG. 3A
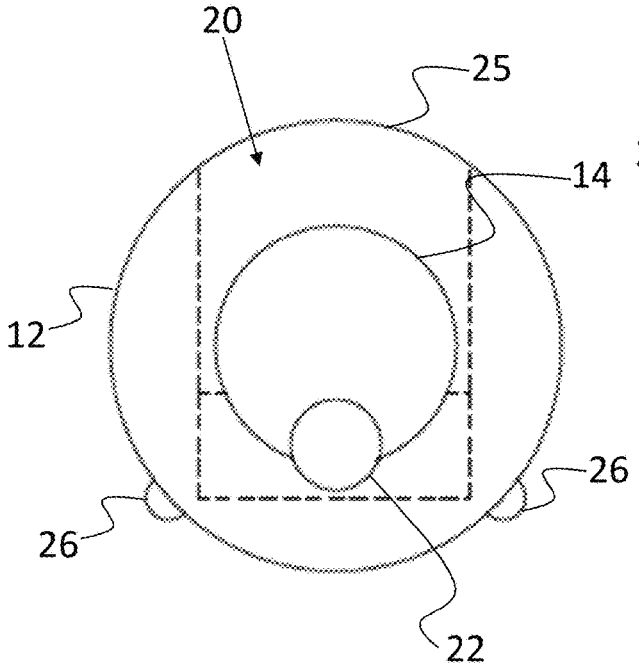
FIG. 3B
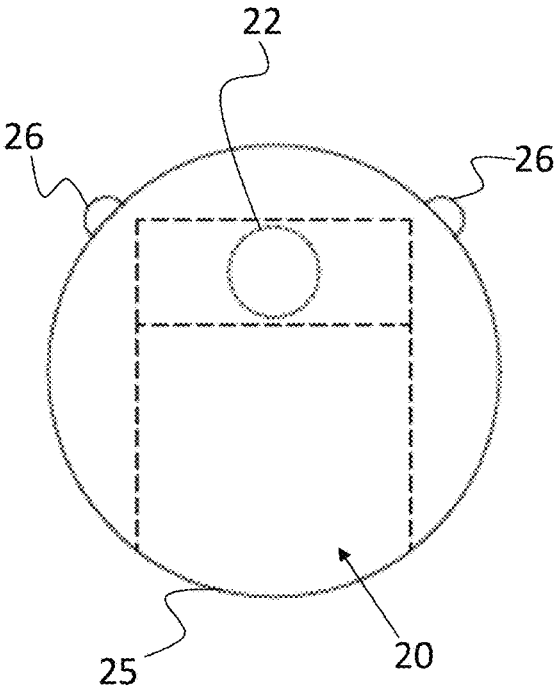
FIG. 3

FIG. 4A
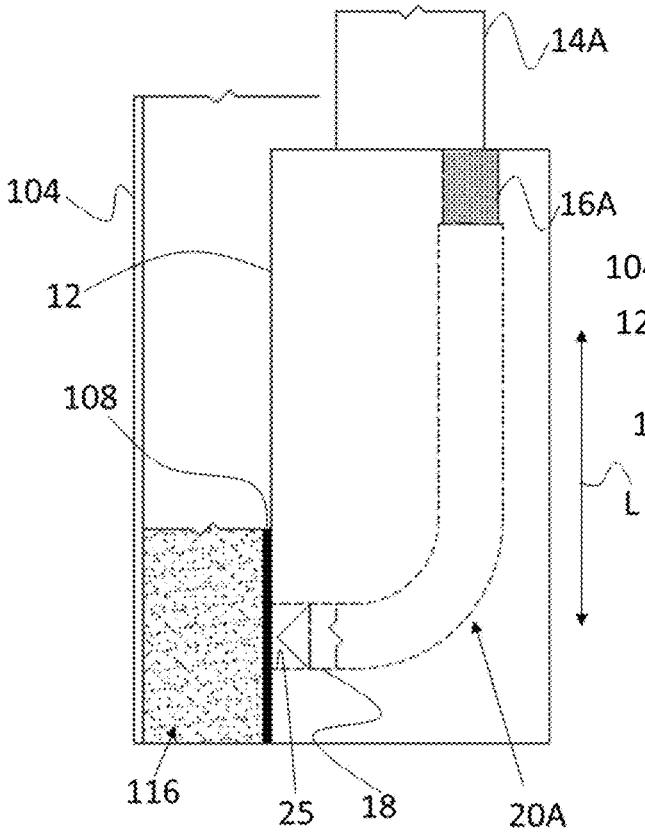
FIG. 4B
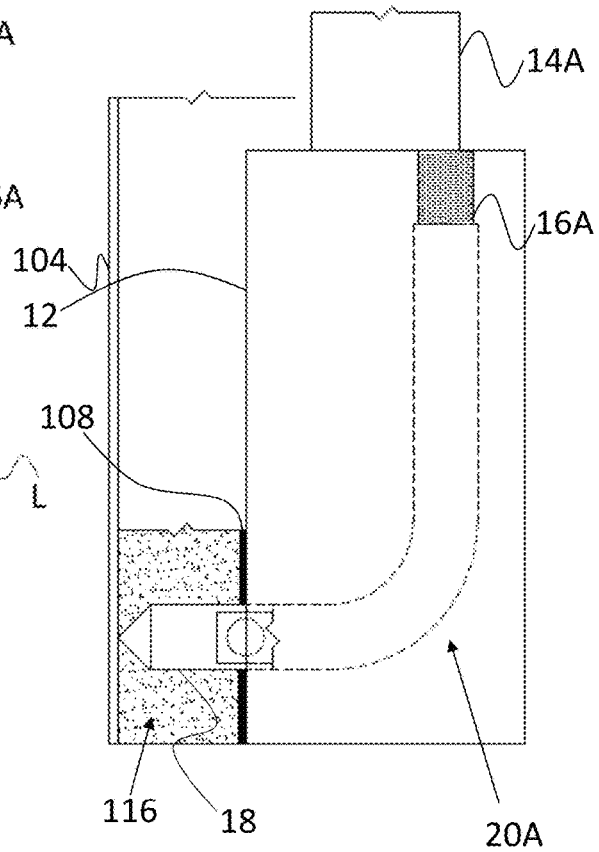
FIG. 4

FIG. 5A
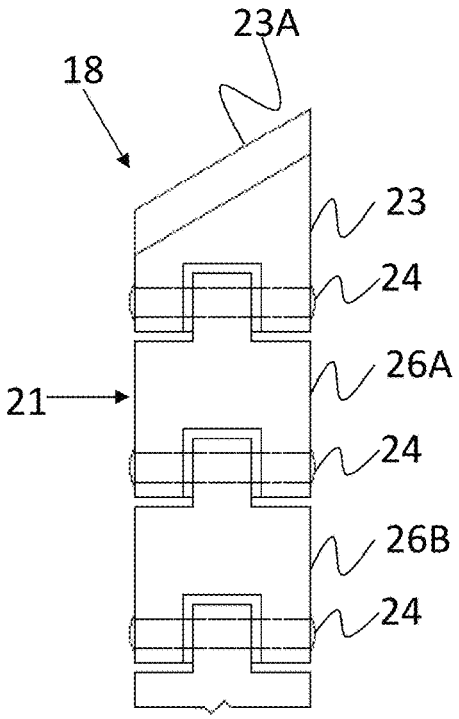
FIG. 5B
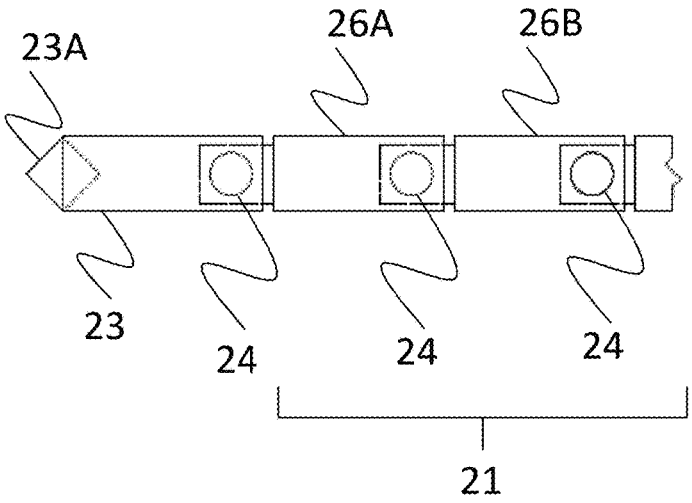
FIG. 5

FIG. 7A
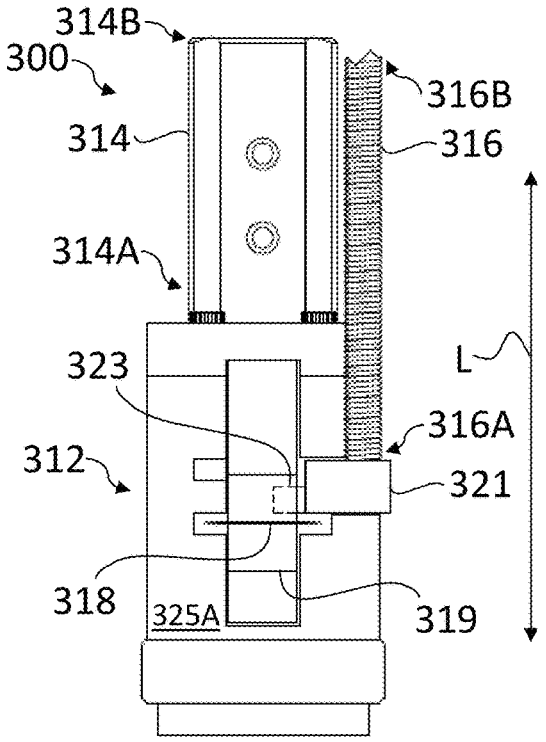
FIG. 7B
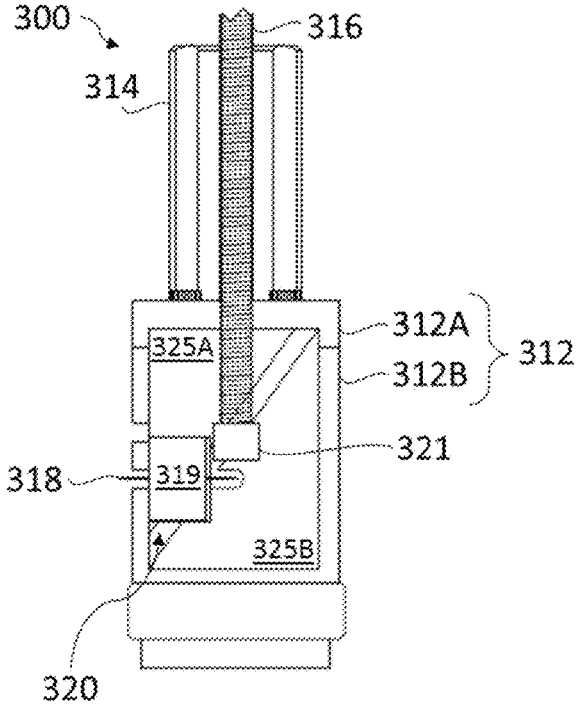
FIG. 7C
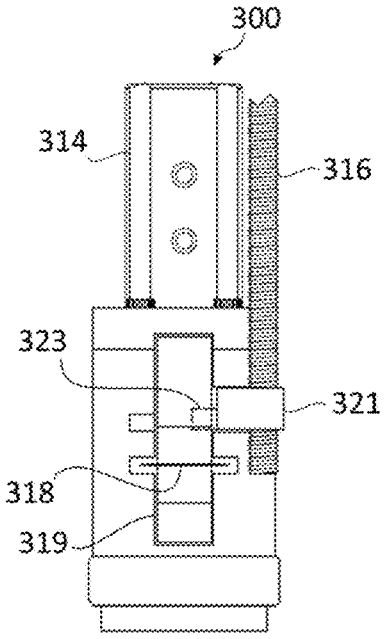
FIG. 7D
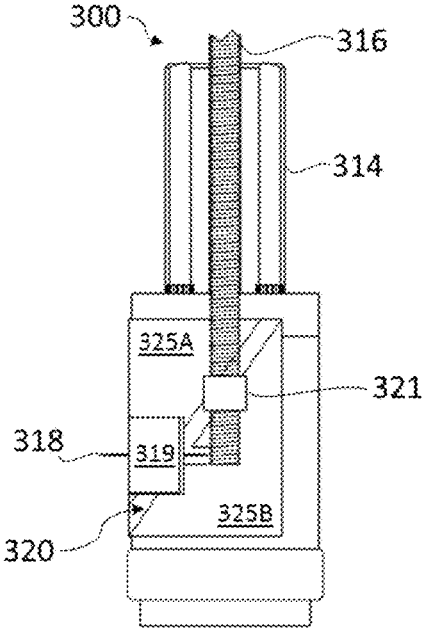
FIG. 7

FIG.8A
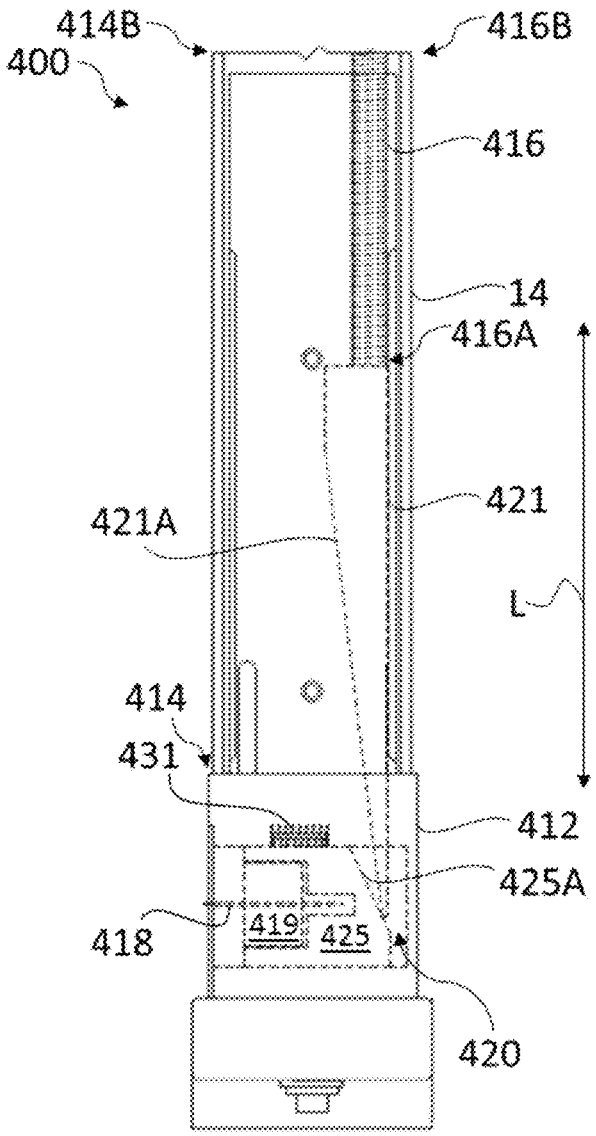
FIG.8B
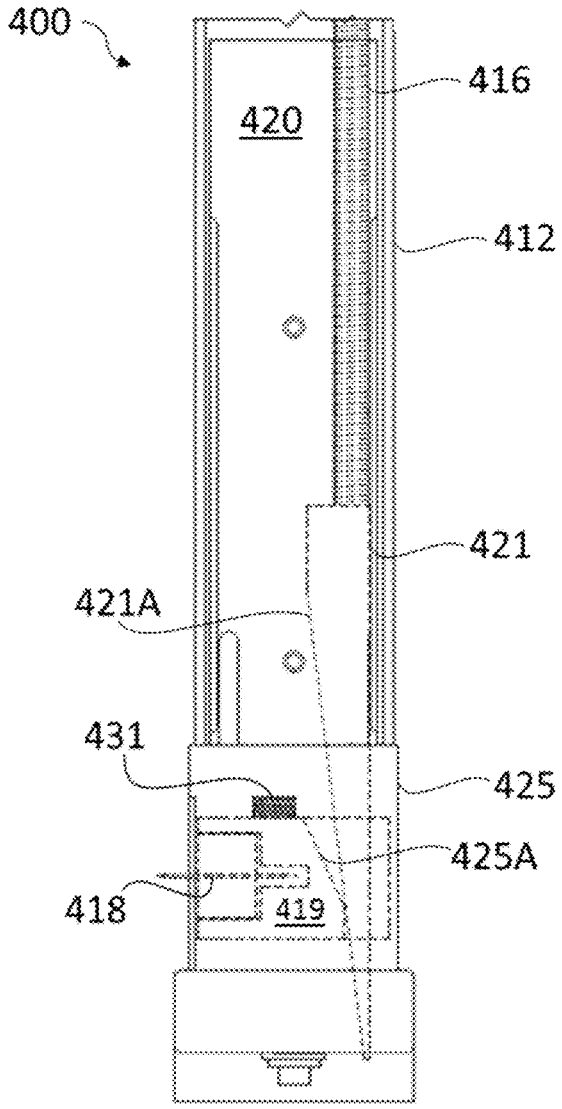
FIG. 8

FIG.10A
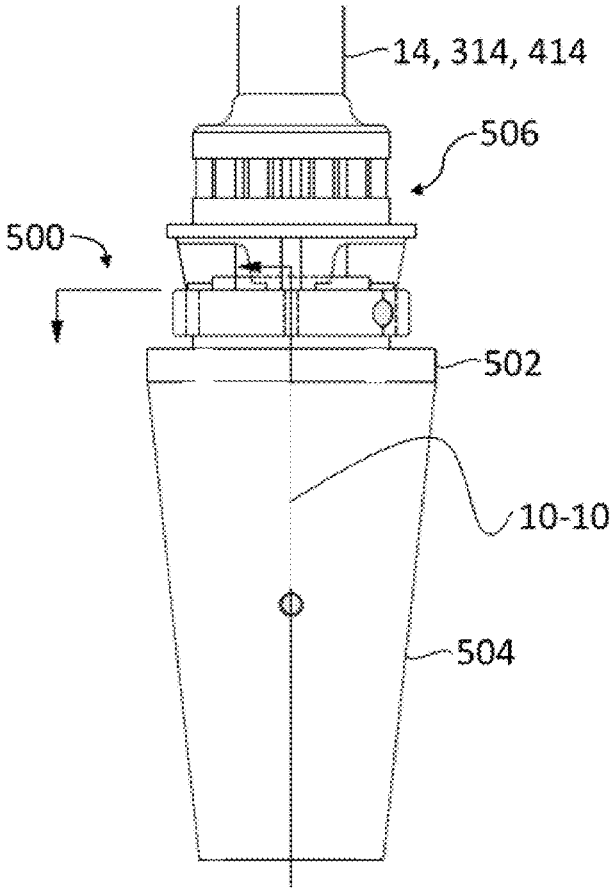
FIG.10B
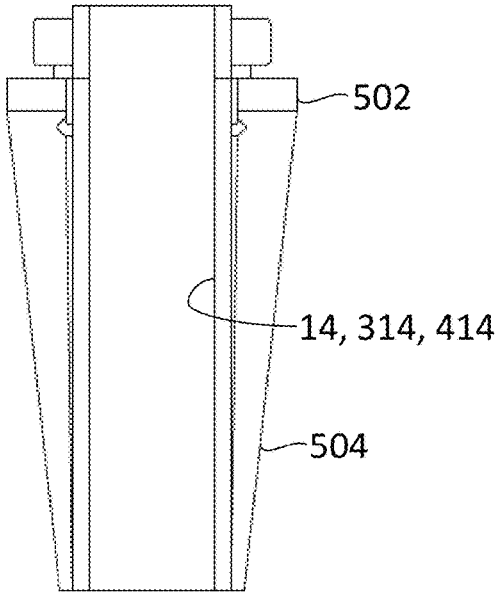
FIG. 10

APPARATUS AND METHOD FOR CUTTING A TUBULAR

CROSS-REFERENCE TO RELATED APPLICATIONS

This application claims priority to Canadian Patent Application No. 2,971,322, filed Jun. 19, 2017. The contents of the referenced application are incorporated into the present application by reference.

TECHNICAL FIELD

This disclosure generally relates to cutting tubulars. In particular, the present disclosure relates to an apparatus and method for cutting a tubular that is part of a pipeline or an oil well or a gas well.

BACKGROUND

In many jurisdictions an oil-well or a gas-well operator has a number of regulatory obligations to meet when a well reaches the end of its production life. In general terms, the well may be abandoned by inserting a plug into the well below the surface in order to prevent fluid communication above the plug. Additionally, branches and dead legs of pipelines often require a similar plugging upon abandonment. The present disclosure may collectively refer to a well and a pipeline as a tubular. The plugging is also accompanied with removal of an above-surface portion of the tubular in order to reclaim the surrounding land at the location of the abandoned tubular.

One known approach for plugging and removing the above-surface portion of the tubular is to excavate the earth surrounding the above-surface portion to gain access to the well or pipeline below the surface. Excavation often requires heavy equipment and/or hydrovac trucks and utility locators to avoid damaging utility lines or other sub-surface infrastructure. Once the excavation is complete, a plug can be inserted into the tubular and the above-surface portion can be cut off and removed. Next, the excavated materials are returned in order to fill in the excavated hole.

A cutting torch can be used to cut the tubular, but the open flame or sparking may pose a safety hazard if volatile hydrocarbons are present.

Another approach for plugging and removing the above-surface portion of the tubular is to insert a plug into the well or pipeline to a predetermined depth below the surface. Once plugged, a high-pressure water cutting tool is inserted into the tubular for cutting the tubular above the plug. Water cutting tools typically require equipment to pressurize the water, clean water source and in some cases, additives such as sand, to be transported to the tubular's location. Access for such tools, water sources and additives to the tubular may be limited by the conditions of the land at the location. Furthermore, water cutting tools may require a heating unit to operate in colder temperatures.

SUMMARY

Some embodiments of the present disclosure relate to a cutter tool for cutting a tubular. The cutter tool includes a housing that is insertable within the tubular and a cutting member that is receivable within the housing. The cutter tool also includes a first shaft with a first shaft-end and a second shaft-end. The first shaft-end is connectable to the housing so that rotating the first shaft causes the housing and the cutting member to rotate within the tubular. The cutter tool also includes a second shaft that is operatively couplable with the second end of the cutting member. The cutting member is moveable between a retracted position and an extended-and-cutting position by moving the second shaft in a first direction or a second direction.

Some embodiments of the present disclosure relate to a method of plugging and cutting a tubular. The method comprises the steps of inserting and setting a plug at a predetermined depth of the tubular. The method also includes a step of inserting a cutting tool into the tubular to a selected depth above the plug. The cutting tool comprises a cutting member that can move between a retracted position and an extended-and-cutting position. The method includes a step of cutting the tubular by rotating the cutting tool and adjusting a position of the cutting member to engage and cut any uncut portion of the tubular to create a cut tubular. The method also includes a step of moving the cutting member into the retracted position and removing the cutting tool from the tubular. The method also includes a step of removing the cut tubular from the ground.

Without being bound by any particular theory, embodiments of the present disclosure may provide advantages over the known tools and methods of cutting tubulars. Embodiments of the present disclosure relate to a cutting tool that provides a "cold cut" which limits the risk of igniting any hydrocarbons that may present at the location of the tubular. Embodiments of the present disclosure also do not require a source of water or additives at the location of the tubular. As such, the embodiments of the present disclosure do not require additional equipment to pressurize and/or heat water at the location of the tubular. This means that access to the location of the tubular may be less restricted when using embodiments of the present disclosure than when using other known approaches. Embodiments of the present disclosure may also provide releasable connections between components of the cutter tool that facilitate relatively easy access for maintenance or replacement of the cutting member.

BRIEF DESCRIPTION OF THE DRAWINGS

These and other features of the present disclosure will become more apparent in the following detailed description in which reference is made to the appended drawings.

FIG. 2 is two schematics of one embodiment of a housing according to the present disclosure for use with the cutter tool of FIG. 1, wherein FIG. 2A shows a partial cutaway, front-elevation view of the housing, and FIG. 2B shows a partial cutaway, side-elevation view of the housing;

FIG. 3 is two schematics of the housing of FIG. 2, wherein FIG. 3A shows a partial cutaway, top-plan view of the housing, and FIG. 3B shows a partial cutaway, bottom-plan view of the housing;

FIG. 4 is two schematics that show the cutter tool within an oil well or a gas well, wherein FIG. 4A shows the cutter tool in a retracted position, and FIG. 4B shows the internal pipe cutter in an extended position;

FIG. 5 is two schematics that show a cutting element for use with the cutter tool of FIG. 1 wherein FIG. 5A is a top-plan view of the cutting element, and FIG. 5B is a side-elevation view of the cutting element;

FIG. 7 is a schematic of a cutter tool according to other embodiments of the present disclosure, wherein FIG. 7A is a front-elevation view of the cutter tool in a retracted position; FIG. 7B is a side-elevation view of the cutter tool in the retracted position; FIG. 7C is a front-elevation view of the cutter tool in an extended position; FIG. 7D is a side-elevation view of the cutter tool in the extended position;

FIG. 8 is a schematic of a cutter tool according to other embodiments of the present disclosure, wherein FIG. 8A is a partial cut-away, side-elevation view of the cutter tool in a retracted position; and FIG. 8B is a partial cut-away, side-elevation view of the cutter tool in an extended position;

FIG. 9 is a schematic of a cutter tool according to other embodiments of the present disclosure, wherein FIG. 9A is a partial cut-away, side-elevation view of the cutter tool in a retracted position; and FIG. 9B is a partial cut-away, side-elevation view of the cutter tool in an extended position;

FIG. 10 is a schematic of a centralizer for use with the cutter tools of the present disclosure, wherein FIG. 10A is a side-elevation view and FIG. 10B is a mid-line cross-sectional view taken through line 10-10 without a transmission.

DETAILED DESCRIPTION

Embodiments of the present disclosure relate to internal tubular cutter tools that can be used to cut tubulars from the inside thereof. Some embodiments of the present disclosure relate to cutter tools that can be used to cut tubulars of oil wells, gas wells, and pipelines. However, those skilled in the art will appreciate that the embodiments of the present disclosure are not limited to use only in oil wells, gas wells, or pipelines. The cutter tools of the present disclosure can also be used to cut tubulars of various sizes and various materials in various types of installations.

The cutter tools of the present disclosure have a cutting member that can be moved between a retracted and an extended position while the cutting member is positioned at the point within the tubular where the cut will be made. The cutter tools can be rotated by equipment at the surface and as the cutting tool is being rotated, the position of the cutting member can be adjusted to start, continue and finish cutting through the tubular. In some embodiments of the present disclosure the position of the cutting member can be adjusted by a user at surface while the cutting tool is being rotated.

Definitions

Unless defined otherwise, all technical and scientific terms used herein have the same meaning as commonly understood by one of ordinary skill in the art to which this disclosure belongs.

As used herein, the term "about" refers to an approximately +/−10% variation from a given value. It is to be understood that such a variation is always included in any given value provided herein, whether or not it is specifically referred to.

Embodiments of the present disclosure will now be described with reference to FIG. 1 though to FIG. 11, which show embodiments of tools and method for cutting a tubular.

Figure 1:
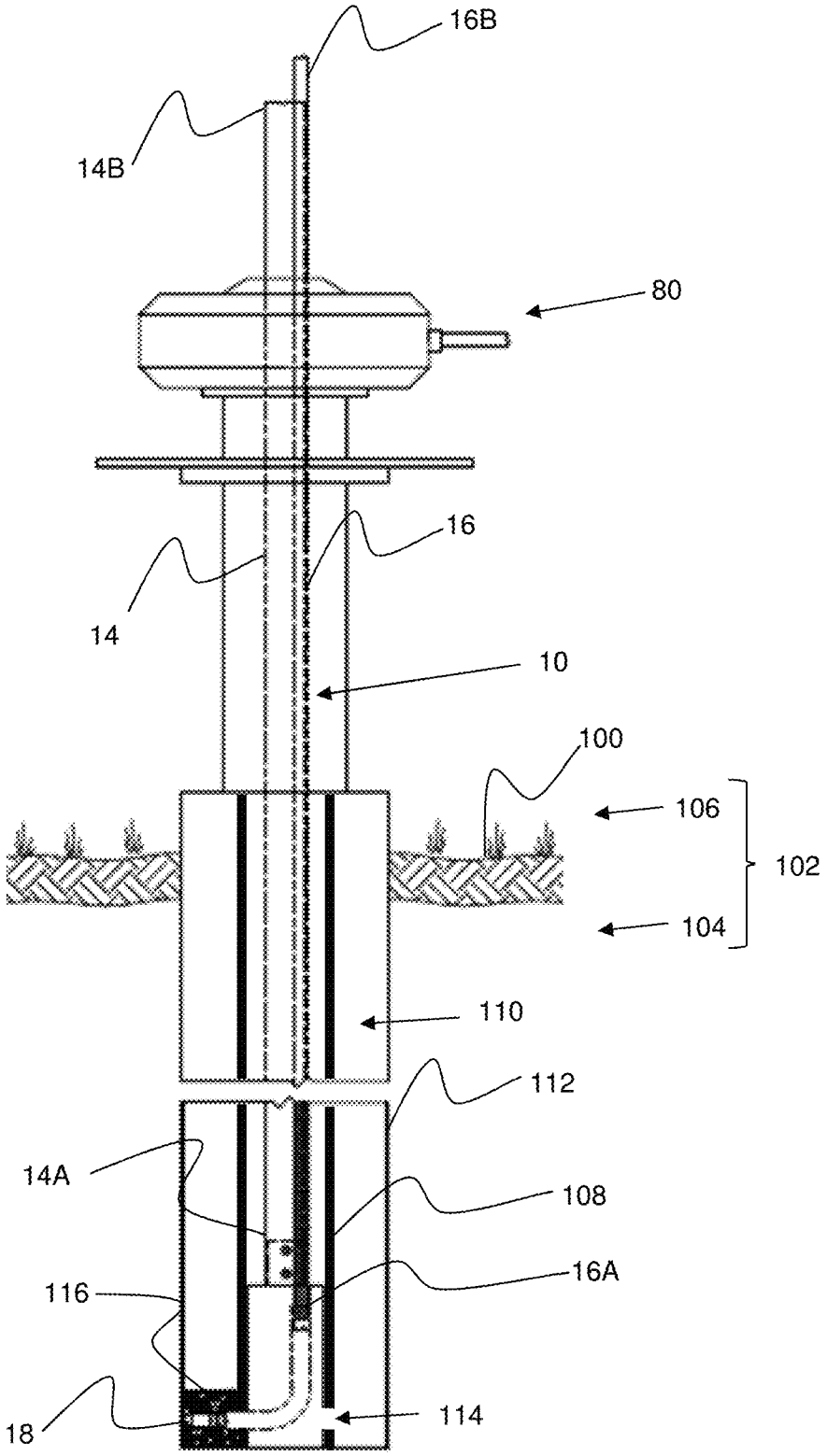
FIG. 1 is a schematic of a cutter tool according to some embodiments of the present disclosure shown positioned within an oil well or a gas well.

FIG. 1 shows a portion of a surface 100 through which a tubular 102 extends. The tubular 102 may be an upper portion of an oil well or a gas well, a portion of an oil pipeline or a gas pipeline, or any other type of tubular conduit including those that have a below-surface portion 104 and an above-surface portion 106. In some instances, the tubular 102 can comprise an inner tubular 108 and an outer tubular 112. In the instance of an oil well or a gas well, the outer tubular 112 can be referred to as casing and the inner tubular 108 can be referred to as tubing, for example production tubing. The inner tubular 108 and the outer tubular 112 can define an annular space 110 therebetween. In some instances, a portion of the annular space 110 may be filled with a material 116 such as concrete. In other instances, for example when the tubular 102 is a portion of a pipeline, there may only be an outer tubular 112 present.

Embodiments of the present disclosure relate to a cutter tool 10 that is insertable into the tubular 102 for adjustably cutting through the tubular 108 so that a portion of the tubular 108 can be removed. FIG. 1 shows a cut region 114 in the inner tubular 108.

Embodiments of the present disclosure relate to the cutter tool 10 that comprises a housing 12, a first shaft 14, a second shaft 16, and a cutting member 18. The first shaft 14 has a first end 14A and a second end 14B. The housing 12 is connectable to the first end 14A. The second shaft 16 has a first end 16A and a second end 16B. The cutting member 18 is operatively couplable with the first end 16A. Double sided arrow L defines a longitudinal axis of the cutting tool 10 (see FIG. 2). For clarity, the term "operatively couplable" means that two components may be directly connected to each other or that they may be coupled to each other through one or more further components and through this direct connection or coupling the two components can perform a given operation or function.

In some embodiments of the present disclosure, the first shaft 14 can be rotated, which in turn, causes the housing 12 to rotate. For example, the first shaft 14 can be rotated by a motor 80 that may be positioned above the surface 100 (as shown in FIG. 1) or below the surface 100. The second shaft 16 can be moved in order to move the cutting member 18 between a retracted position and an extended-and-cutting position, as will be described further below. When the cutting member 18 is in the retracted position, the cutting member 18 can be substantially or completely inside the housing 12 so as to reduce the chance that the cutting member 18 will physically interfere with moving the cutting tool 10 into and out of the tubular 102. However, the retracted position is not limited to mean that the entire cutting member 18 is positioned within the housing 12. When the cutting member 18 is in the extended-and-cutting position and when the first shaft 14 is rotated, the cutter tool 10 can engage and cut through the tubular 102.

In some embodiments of the present disclosure, the housing 12 has a cylindrical shape with a circular cross-section that defines an outer diameter of the housing 12 (see FIG. 3). The dimensions of the outer diameter of the housing 12 can be selected to provide a substantially tight fit within the inner-most diameter of the tubular 102. The inner-most diameter of the tubular 102 can be the inner tubular 108 or the outer tubular 112, as the case may be. For clarity, the term "substantially tight fit" means that there is an annular-space defined between the outer diameter of the housing 12 and the inner-most diameter of the tubular 102 so that the cutter tool 10 can be inserted into and axially displaced within the tubular 102. In some embodiments of the present disclosure, the outer diameter of the housing 12 can be selected so that the radial distance between the outer diameter of the housing 12 and the inner surface of the inner-most diameter of the tubular 102 is between about 0.25 cm and about 10 cm.

As shown in FIG. 2A, FIG. 2B, FIG. 3A and FIG. 3B, the housing 12 defines an internal chamber 20 that extends from an upper section 22 through to a lower section 24. The upper section 22 receives the first end 16A of the second shaft 16 for operatively coupling with the cutting member 18 that is housed within the internal chamber 20. In some embodiments of the present disclosure, the internal chamber 20 has a curvilinear section 20A between the upper section 22 and the lower section 24. Via the curvilinear section 20A, the internal chamber 20 may change direction between the upper section 22 and the lower section 24. In some embodiments of the present disclosure, the upper section 22 may be substantially parallel to a longitudinal axis (shown by the double arrowed line L) of the cutting tool 10. The upper section 22 may be oriented relative to the lower section 24 at an angle $\alpha$ of between about 45 degrees and about 180 degrees (see FIG. 2B). In some embodiments of the present disclosure, the angle $\alpha$ is between about 45 degrees and 135 degrees. In further embodiments of the present disclosure, the angle $\alpha$ is about 90 degrees, which means that the upper section 22 is substantially perpendicular to the lower section 24.

The internal chamber 20 extends through a lateral wall of the housing 12 to define a cutting aperture 25 (see FIG. 3 and FIG. 4A). In some embodiments of the present disclosure, the housing 12 may include one or more bearing members 26. The bearing members 26 can be positioned substantially opposite to the cutting aperture 25. The bearing members 26 are configured to bear against the inner surface of the inner-most diameter of the tubular 102 to reduce the surface area of the housing that comes into contact with the tubular 102, which may reduce the friction generated between the cutting tool 10 and the tubular 102 as the cutting tool 10 moves through the tubular 102. The bearing members 26 may also help stabilize the housing 12 as the cutting member 18 moves towards and cuts through the tubular 102. In some embodiments of the present disclosure the bearing members 26 may rotate to facilitate movement of the housing 12 within the tubular 102. For example, the bearing members 26 may be roller bearings, ball bearings, wheels, or combinations thereof.

As shown in FIG. 3A, the second shaft 16 may be partially nested within the first shaft 14. For example, the first shaft 14 may define a recess that extends along the longitudinal axis of the first shaft 14 (not shown). The recess is configured to receive the second shaft 16 therein. In other embodiments of the present disclosure, the recess may be a central bore of the first shaft 14 and the second shaft 16 may be entirely nested within the first shaft 14. Nesting, either partially or entirely, may reduce the physical interference that may be caused by the second shaft 16 when rotating the first shaft 14. When nested within the recess, the second shaft 16 can be moved so as to move the cutting member 18 between the retracted position and the extended-and-cutting position.

In other embodiments of the present disclosure, the second shaft 16 is not nested, either partially or entirely, within the first shaft 14.

In some embodiments of the present disclosure, the second shaft 16 can move along the first shaft 14 and in either direction substantially parallel to the longitudinal axis L. In some embodiments of the present disclosure, movement of the second shaft 16 longitudinally along the first shaft 14 can be in a controlled manner so that the second shaft 16 can move a desired amount and then be held at a desired position until such time that it is desirable to move the second shaft 16 to a new desired position. As a non-limiting example, a portion of the second shaft 16 may be threadedly received within the upper section 22 and rotating the second shaft 16 in a first direction causes the second shaft 16 to travel along threads in the upper section 22 and thereby to move longitudinally in a direction towards the housing 12. Rotating the second shaft 16 in a second direction, which is opposite to the first direction, will cause the second shaft 16 to move in a direction away from the housing. In other non-limiting examples, another type of control mechanism, for example a releasable ratchet-mechanism, may be provided so that the second shaft 16 can move in a controlled manner without requiring rotation of the second shaft 16.

As shown in FIG. 4, the cutting member 18 is housed within the internal chamber 20 of the housing 12. FIG. 4A shows the cutting member 18 in a retracted position and FIG. 4B shows the cutting member 18 in an extended position. The cutting member 18 can slidingly move within the internal chamber 20 from the retracted position through a range of extended positions to an extended-and-cutting position where the cutting member 18 can engage and cut through the tubular 108. However, the extended-and-cutting position is not a predefined position of the cutting member 18 relative to the housing 12. Rather, the extended-and-cutting position is a reference to when the cutting member 18 is not in the retracted position and the cutting member 18 is in a position for engaging and cutting through the tubular 102. Because the cutting member 18 will remove material from the wall of the tubular 102 during the cutting operation, the position of the cutting member 18 may be adjusted so the cutting member 18 to advance the cutting member 18 through uncut material of the tubular 102. As such, any position where the cutting member 18 can engaged and can cut through the tubular 102 is considered to be the extended-and-cutting position.

The cutting member 18 can be made of a material that can cut through any of metal, metal alloys, cement and other composites that are used to make tubulars. In some embodiments of the present disclosure the cutting member 18 can cut through tubulars without generating any ignition hazards such as sparks. For example the cutting member 18 can be made of steel, stainless steel, one or more carbides or combinations thereof.

In some embodiments of the present disclosure, the cutting member 18 comprises a cutting element 23 that is releasably connectable to a flexible body 21 (see FIG. 5). The flexible body 21 is connectable to the first end 16A of the second shaft 16. Optionally, the flexible body 21 is releasably connectable to the first end 16A.

The cutting element 23 has a cutting edge 23A that is configured to cut through the material of the tubular 102 and any materials 116 that may be present. Opposite to the cutting edge 23A, the cutting element 23 is configured to be pivotally and releasably connectable to the flexible body 21.

The flexible body 21 is configured to move about a single plane that is substantially perpendicular to the longitudinal axis L. The flexible body 21 can translate the movement of the second shaft 16 along the longitudinal axis L of the first shaft 14 into an orientation that is perpendicular to the longitudinal axis of the first shaft 14. For example, the flexible body 21 may be directly or indirectly connected to the first end 16A of the second shaft 16 and movement of the second shaft 16 towards the housing 12 causes the flexible body 21 to slidingly move through the internal chamber 20, which in turn causes the cutting element 23 to move towards or through the cutting aperture 25 to an extended position. When the second shaft 16 moves away from the housing 12 the cutting element 23 moves away from the extended position towards the retracted position.

FIG. 5A and FIG. 5B show a non-limiting embodiment of the flexible body 21 that comprises a pivot pin 24 for pivotally connecting the cutting element 23 to a first link 26A and another pivot pin 24 for pivotally connecting the first link 26A to a second link 26B and so on. The flexible body 21 may include one or more links 26 that are each pivotally connectable to each other by pivot pins 24. The pivotal connections that comprise the flexible body 21 translates movement of the second shaft 16 towards or away from the housing 12 into movement of the cutting member 18 through the internal chamber 20, including through the curvilinear section 20A.

Figure 6:
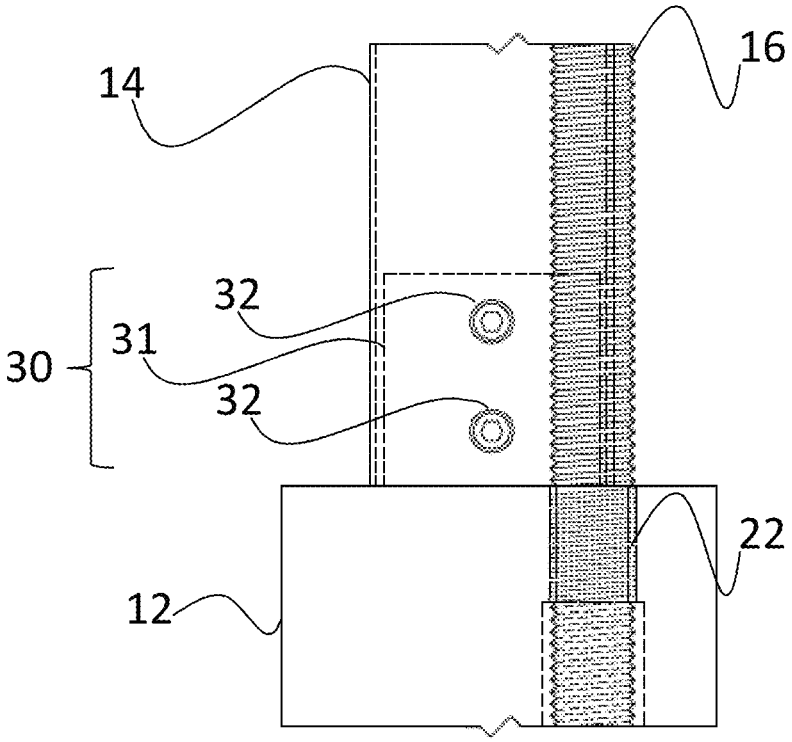
FIG. 6 is a side-elevation view of an upper portion of the housing of FIG. 2.

FIG. 6 shows a closer view of a non-limiting option of a releasable connection 30 that releasably connects the first end 14A of the first shaft 14 to the housing 12. The releasable connection 30 operatively connects the first shaft 14 to the housing 12 so that when the first shaft 14 is rotated, the housing 12 will rotate with the first shaft 14. The releasable connection 30 is made from materials that are strong enough to transfer the torque generated by rotating the first shaft 14 while keeping the first shaft 14 connected to the housing 12. The releasable connection 30 can comprise a bracket 31 that is fixed to an upper surface of the housing 12. The bracket 31 receives the first end 14A of the first shaft 14. The bracket 31 defines one or more connector apertures (not shown) that can be aligned with one or more matching apertures (not shown) in the first end 14A. When aligned, the connector apertures and the matching apertures can each receive a connection member 32 therethrough for connecting the first shaft 14 to the housing 12. The connection members 32 can be releasably held in place for example by a nut, a connector pin, or other suitable mechanism that will be appreciated by those skilled in the art. Furthermore, those skilled in the art will appreciate that the releasable connection member 30 can include various other configurations and components that will releasably connect the first shaft 14 to the housing 12 while translating the rotational movement of the first shaft 14 and the associated torque to the housing 12.

Without being bound by any particular theory, the releasable connection 30 between the first shaft 14 and the housing 12 may facilitate maintenance and replacement of the cutting member 18. For example, the first shaft 14 can be released from the housing 12, which in turn allows the second shaft 16 to be removed from the housing 12. Removing the second shaft 16 from the housing also removes the cutting member 18 from the internal chamber 20 and allows the user access to the cutting element 23 for maintenance or replacement.

FIG. 7 shows a cutter tool 300 according to other embodiments of the present disclosure. The cutting tool 300 performs the same general function as the cutting tool 10 described above, namely the adjustable cutting of a tubular 102. The cutting tool 300 comprises a housing 312, a first shaft 314, a second shaft 316, and a cutting wheel 318. The first shaft 314 has a first end 314A and a second end 314B. The housing 312 is operatively couplable to the first end 314A. The second shaft 316 has a first end 316A and a second end 316B. The cutting member 18 is operatively connectable with the first end 316A. Double sided arrow L defines a longitudinal axis of the cutting tool 300.

The first end 316A is coupled to a keyway body 321 that includes an extension 323. The cutter tool 300 also comprises a cutting-wheel mount 319 that retains the cutting wheel 318. The cutting-wheel mount 319 is housed within a keyed body 325, which is housed within the housing 312. The keyed body 325 may have a first portion 325A and a second portion 325B together which define a keyway 320 through the housing 312. The keyway 320 receives the extension 323 therein and the combination of the keyway 320 and the keyway body 321 translate movement of the second shaft 316 into movement of the keyed body 325 within the housing 312. For example, when the second shaft 316 moves in a first shaft direction the keyed body 325 also moves in the first shaft direction, which causes the keyed body 325 to move in a first direction. When the second shaft 216 moves in a second shaft direction, which is opposite to the first shaft direction, the keyed body 325 moves in a second direction. Therefore, movement of the second shaft 316 results in the cutting wheel 318 moving between a retracted position and an extended position, or vice versa. Movement of the second shaft 316 can be axial movement that is substantially parallel to the longitudinal axis L of the cutting tool 300, rotational movement that is about the longitudinal axis L or both.

In FIG. 7A the cutting wheel 318 is in the retracted position and the position of the extension 323 is closer towards the bottom of the housing 312 than in FIG. 7C where the cutting wheel 318 is shown in an extended position. In comparing the position of the keyway body 321 in FIG. 7B and FIG. 7D it is illustrated how movement of the second shaft 316 results in the keyway body 325 moving within the housing 313 between the retracted position and an extended position. Movement of the keyway body 325 results in the cutting wheel 318 moving between the retracted position and the extended-and-cutting position.

In the non-limiting examples shown in FIG. 7, the orientation of the keyway 320 results in movement of the cutting wheel 318 from a retracted position towards the extended-and-cutting position as the second shaft 321 moves upwardly. When the second shaft 316 moves downwardly the cutting wheel 318 moves towards the retracted position. As will be appreciated by those skilled in the art, the orientation of the keyway 320 can be different but still result in a translation of movement of the second shaft 316 into movement of the keyway body 325 and the cutting wheel 318.

Also as shown in FIG. 7B, in some embodiments of the present disclosure, the housing 312 can be modular and made of multiple components including an upper portion 312A and a lower portion 312B. Alternatively, the housing 312 can be a unitary component of the cutting tool 300.

Rotating the first shaft 314 results in the housing 312 rotating. As the cutting wheel 318 rotates with the housing 312 and movement of the second shaft 316 can cause the cutting wheel 318 to extend further from the retracted position so that the cutting member will cut through the tubular 102.

FIG. 8 shows a cutting tool 400 according to other embodiments of the present disclosure. The cutting tool 400 performs the same general function as the cutting tools 10, 300 described above, namely the adjustable cutting of a tubular 102. The cutting tool 400 comprises a housing 412, a first shaft 414, a second shaft 416, and a cutting wheel 18. The first shaft 414 has a first end 414A and a second end 414B. The second shaft 416 has a first end 416A and a second end 416B. The housing 412 is operatively couplable to the first end 414A. The cutting wheel 18 is operatively couplable with the first end 416A. Double sided arrow L defines a longitudinal axis of the cutting tool 400.

FIG. 8 shows the cutting wheel 418 housed within a cutting-wheel mount 419 and both are operatively couplable to the second shaft 416 by a first cam-member 421 and a second cam-member 425.

The first cam-member 421 is connected to the first end 416A and the first cam-member 421 extends away from the first end 416A substantially along the longitudinal axis L. In some embodiments of the present disclosure, the first cam-member 421 can have a wedge shape with the thickest portion of the wedge proximal to the first end 416A and the thinnest portion of the wedge is opposite to the first end 416A. The first cam-member 421 defines a first cam-surface 421A that extends downwardly toward the second cam-member 425, which is positioned below the first end 416A.

The second cam-member 425 is housed within an internal chamber 420 of the housing 412. The second cam-member 425 houses the cutting-member block 419. The second cam-member 425 can move within the internal chamber 420 substantially perpendicular to a longitudinal axis L of the cutting tool 400. The second cam-member 425 defines a second cam-surface 425A.

A portion of the first cam-member 421 extends through an opening (not shown) in the upper portion of the housing 412 to contact the second cam-surface 425A. Movement of the second shaft 416 in a first direction causes the first cam-surface to 421A to slidingly move along the second cam-surface 425A. This movement of the first cam-member 421 causes the second cam-member 425 and the cutting wheel 18 housed therein to move from a retracted position (FIG. 8A) towards an extended position (FIG. 8B). When the second shaft 416 moves in a second direction, which is opposite the first direction, a biasing member 431 pushes the second cam-member 425 back towards the retracted position. The biasing member 431 is positioned between a shoulder (not shown) of the housing 412 and a shoulder (shoulder) of the second cam-member 425 so that when the second cam-member 425 moves towards the extended-and-cutting position the biasing member 431 is compressed between the two shoulders.

Rotating the first shaft 412 results in the housing 412 rotating. As the cutting wheel 18 rotates with the housing 412 and movement of the second shaft 416 causes the cutting wheel 18 to extend further from the retracted position the cutting wheel 18 will cut through the tubular 102.

Figure 9:
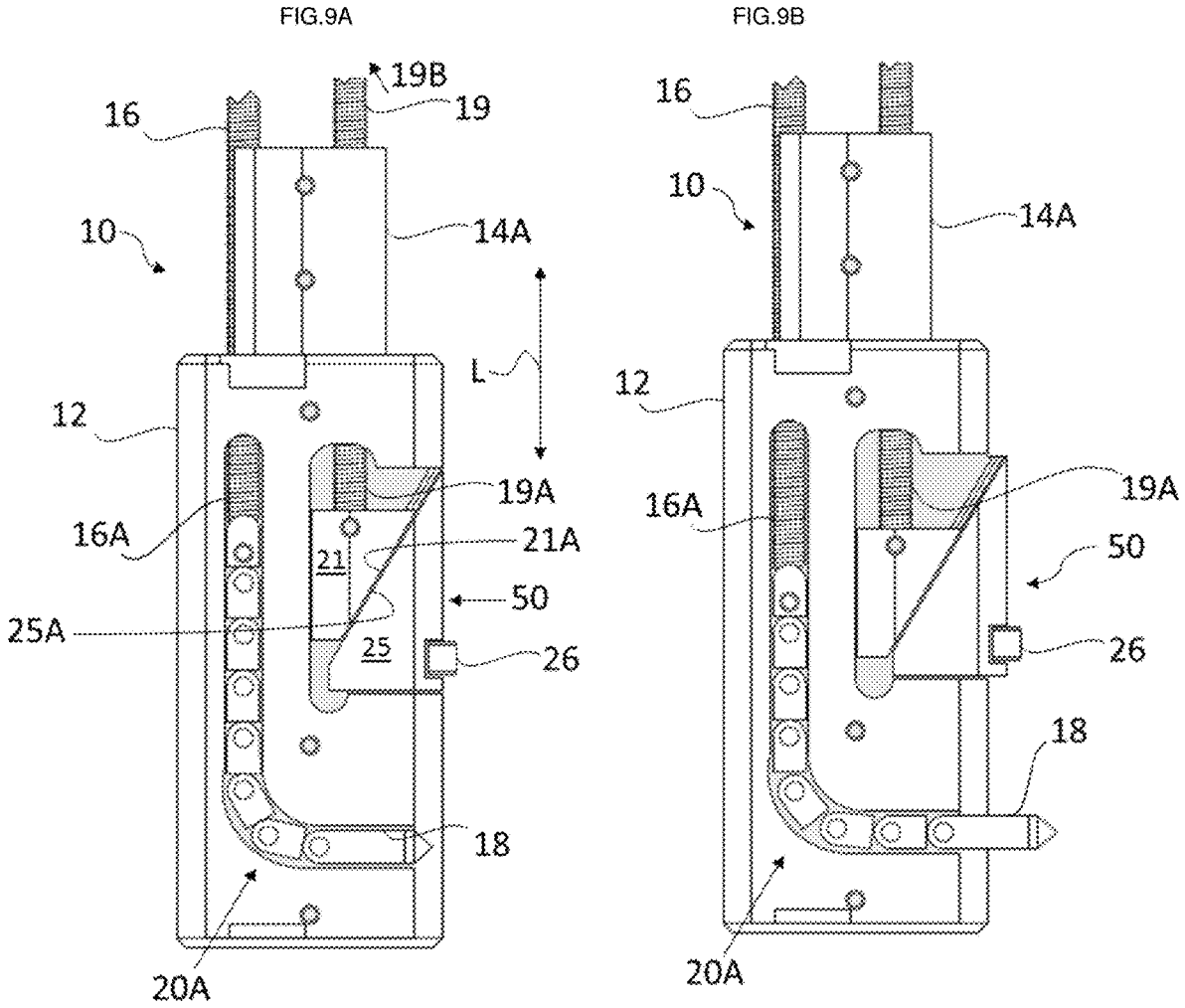

FIG. 9 shows further embodiments of the present disclosure that include a wedge assembly 50 incorporated into the housing 12 for use with the cutting tool 10 described herein above. As will be appreciated by those skilled in the art, the wedge assembly 50 can be incorporated into the housing 312, 412 of cutting tools 300, 400 as also. As such, the description of the wedge assembly 50 relative to the cutting tool 10 is similarly applicable to the cutting tools 300, 400. Furthermore, the position of the wedge assembly 50 can be different than as shown in FIG. 9. For example, the wedge assembly 50 can be positioned diametrically opposed to where the cutting element 18 exits the housing 12, or elsewhere.

The wedge assembly 50 comprises a third shaft 19, a first body 21, a second body 25 and at least one bearing member 26. The third shaft 19 has a first end 19A and a second end 19B. The first body 21 is operatively couplable to the first end 19A so that movement of the third shaft 19 along the longitudinal axis L of the cutting tool 10 will cause the first body 21 to move as well. The first body 21 defines a first body-surface 21A that is in contact with a second body-surface 25A that is defined by the second body 25. The second body 25 has an outer surface that is shown in FIG. 9A as substantially co-planar with an outer surface of the housing 12, this may be referred as to as a retracted position. When the first body 21 moves the contact between the first body-surface 21A and the second body-surface 25A causes the second body 25 to move substantially perpendicular to the longitudinal axis L so that the outer surface of the second body 19B is no longer substantially co-planar with the outer surface of the housing 12, this may be referred to as an extended position. The at least one bearing member 26 is rotatably housed within the second body 25.

When the cutting tool 10 is inserted into a cutting position within a tubular 102, the third shaft 19 can be moved in a first direction to cause the second body 23 to move outwardly from the housing 12 so that the at least one bearing member 26 comes into contact with the inner surface of the tubular 102. This contact may help stabilize the cutting tool 10 during cutting of the tubular 102. When cutting is complete, the third shaft 19 can be moved in a second direction, which is opposite the first direction, to cause the second body 23 and the at least one bearing member 26 to move away from the inner surface of the tubular 102.

FIG. 10 shows a centralizer 500 according to some embodiments of the present disclosure. The centralizer 500 may comprise an outer edge 502 and a guiding surface 504. The centralizer can be positioned above the housing 12, 312, 412 and assist in stabilizing the housing 12, 312, 412 at a centralized position within the tubular 102. The outer diameter of the outer edge 502 can be selected based upon the dimensions of the inner diameter of the tubular 102 so that the cutting tool 12, 312, 412 can be moved into and out of the tubular 102 but with a substantially tight fit within the tubular 102. The guiding surface 504 may assist with insertion of the centralizer 500 into the tubular 102. In some embodiments of the present disclosure relate to a centralizer 500 with a transmission 506. The transmission 506 may include a series of gears (not shown) to increase the rotational speed of the housing 12, 312, 412, and therefore the cutting element 18 or cutting wheel 318, 418, without increasing the rotational output speed of the motor 80. As shown in FIG. 10A the first shaft 14 of the cutting tool 10 is operatively couplable to the transmission 506. However, as shown in FIG. 10B (where the transmission 506 is not included) the centralizer 500 may comprise a central bore through which the first shaft 14 extends to operatively couple with the housing 12 below.

Figure 11:
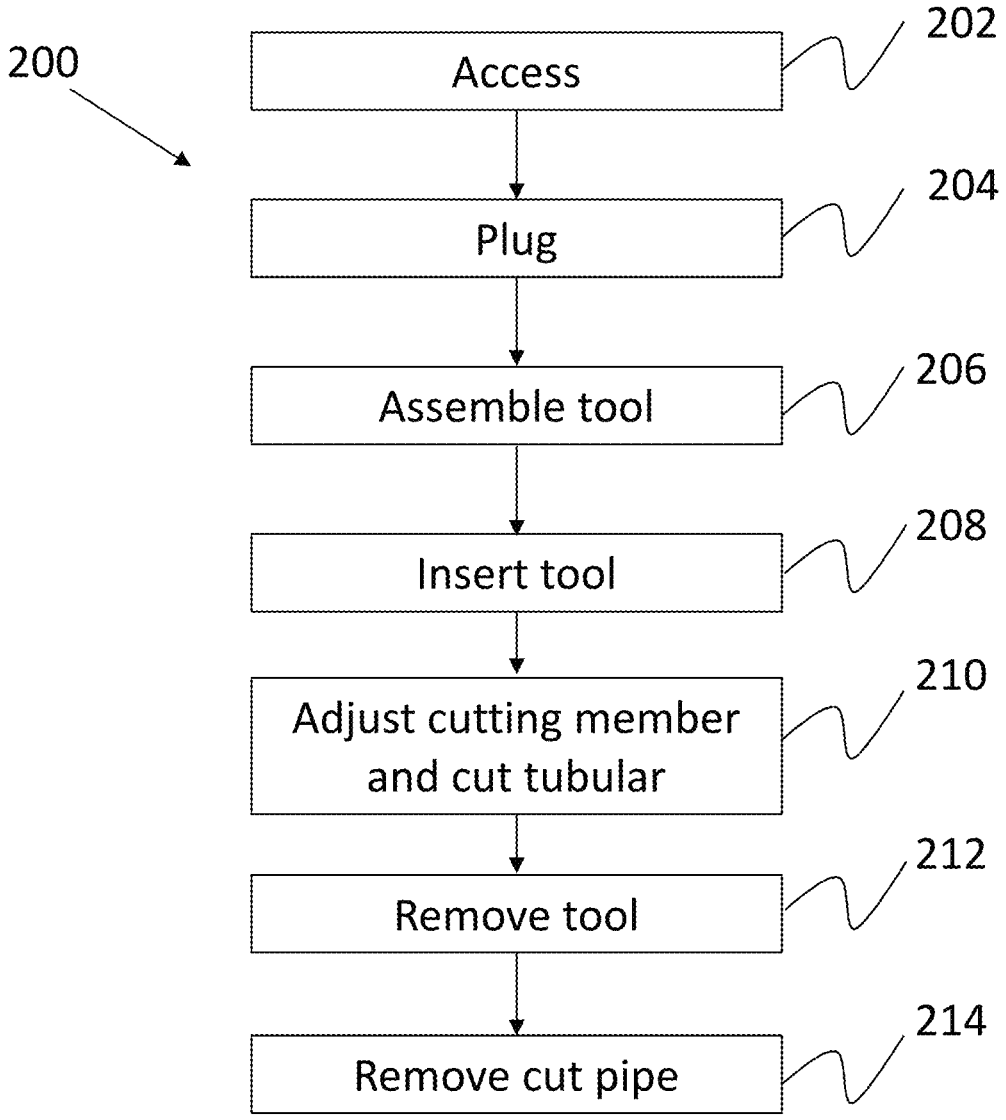
FIG. 11 is a schematic flow-chart that represents a method of abandoning an oil well or a gas well according to embodiments of the present disclosure.

In operation, the cutter tools 10, 300, 400 can be used in a plug-and-cut operation 200 for abandoning the tubular 102, such as an oil well or a gas well or a pipeline (see FIG. 11). The operation 200 comprises at least the step of accessing 202 the location of the tubular 102. Because the cutter tools 10, 300, 400 do not require high pressure pumps, large reserves of water or additives, the step of accessing 202 the location of the tubular 102 may be less onerous than other known approaches to cutting tubulars.

The operation 200 includes a next step of plugging 204 the tubular 102. The plug will be installed and set at a predetermined depth within the tubular 102 based upon industry practice or regulated standards. The type of plug used for the plugging step 204 is determined by the status of the tubular 102 to reduce or prevent leak of any contents of the tubular 102 out of the tubular 102.

The operation 200 includes a further step of assembling 206 the cutter tool 10, 300, 400. For example, the dimensions of the housing 12, 312, 412 can be selected to ensure a substantially tight fit within the tubular 102. Then, the first shaft 14, 314, 414 can be releasably connected to the housing 12, 312, 412 by the releasable connection member 30. The cutting element 18 or cutting wheel 318, 418, can be moved into the retracted position by moving the second shaft 16, 316, 416 along the longitudinal axis L of the cutting tool 10, 300, 400.

The operation 200 includes a further step of inserting 208 the cutter tool 10, 300, 400 within the tubular 102. The step of inserting 208 the cutter tool 10, 300, 400 may also include a step of adjusting the axial depth of the cutter tool 10, 300, 400 within the tubular 102 so that the cutter tool 10, 300, 400 is a predetermined axial distance from the plug. For example, the position of the cutter tool 10, 300, 400 can be adjusted to a depth of between about 1.27 cm and about 10 cm above the plug. In some embodiments of the present disclosure, the cutter tool 10, 300, 400 can be adjusted to a depth of between about 2.54 cm and about 5 cm above the plug. When the step of adjusting 208 is complete, the cutter tool 10, 300, 400 will typically not be moved to change the axial depth of the cutter tool 10, 300, 400 within the tubular 102 unless a different axial depth for cutting must be selected due to an issue at the first selected axial depth. For clarity, the term axial depth refers to distance within the tubular 102 and it is not restricted to a depth below the surface 100. In some embodiments of the present disclosure the cutting tools 10, 300, 400 can cut at an axial depth of up to about 85 meters.

The operation 200 includes a further step of cutting 210 the tubular 102. The step of cutting 210 includes moving the cutting element 18 or cutting wheel 318, 418, from the retracted position to the extended-and-cutting position by moving the second shaft 16, 316, 416 along the longitudinal axis L. When the cutting element 18 or cutting wheel 318, 418, cannot be extended any further typically indicates when the cutting edge 23A has come into contact with the inner surface of the tubular 102. At this point, or before, the second end 14B, 314B, 414B of the first shaft 14, 314, 414 can be operatively connected to a motor 80 that rotatably drives the first shaft 14, 314, 414 at a speed of between about 16 and 200 rpm with sufficient torque to allow the cutting element 18 or cutting wheel 318, 418, to cut through the tubular 102. Then, the motor 80 is engaged to rotate the first shaft 14, 314, 414 so that the cutting element 18 can begin cutting the inner surface of the tubular 102.

As the cutting step 210 proceeds and as part of the step of cutting 210, the user may perform a further step of adjusting the position of the cutting element 18 or cutting wheel 318, 418, by moving the second shaft 16, 316, 416 either towards or away from the tubular 102, depending on how the step of cutting 210 is progressing. The movement of the second shaft 16, 316, 416 can occur directly by the user (i.e. by hand) or with any form of mechanical assistance. The user may adjust the position of the cutting element 18 or cutting wheel 318, 418, to ensure that the cutting element 18 or cutting wheel 318, 418, is in the extended-and-cutting position. For example, if the tubular 102 has both an inner tubular 108 and an outer tubular 112, the position of the cutting element 18 or cutting wheel 318, 418, can be adjusted to extend and cut through the inner tubular 108, then the position of the cutting member 18 can be adjusted again to extend the cutting element 18 or cutting wheel 318, 418, to engage and cut through the outer tubular 112. In some operations 200, there may be material 116 between the inner tubular 108 and the outer tubular, for example concrete. The step of adjusting the position of the cutting element 18 or cutting wheel 318, 418, will also cause the cutting element 18 or cutting wheel 318, 418, to cut through such material 116.

The step of cutting 210 will cause the cutting element 18 or cutting wheel 318, 418, to cut through tubulars 102 with walls that are made of one or more polymers, metal such as iron, steel, cement or other materials that are used in the fabrication of tubulars 102. In some embodiments of the present disclosure, the cutting element 18 or cutting wheel 318, 418, can cut through tubulars 102 that have an inner diameter between about 2.54 cm to about 31.75 cm. The step of cutting 210 will allow the cutting element 18 or cutting wheel 318, 418, to cut through tubulars 102 with different wall thickness. For example, the cutting element 18 or cutting wheel 318, 418, can cut through at least 0.188 pile pipe, 0.280 pile pipe and other thinner or thicker walled tubulars 102. In some embodiments of the present disclosure the cutting step 210 will involve rotating the first shaft 14, 314, 415 at between about 30 and about 35 rpm. In other embodiments that include the transmission 506 the housing 12, 312, 412 may rotate at between about 135 and about 165 rpm.

The operation 200 includes a further step of removing 212 the cutter tool 10, 300, 400 from the tubular 102 when the step of cutting 210 is complete. The step of removing 212 includes a step of retracting the cutting element 18 or cutting wheel 318, 418, from the extended-and-cutting position towards or to the retracted position so that the cutting element 18 or cutting wheel 318, 418, does not interfere with pulling the cutter tool 10, 300, 400 out of the tubular 102.

The operation 200 includes a further step of removing 214 the cut tubular 102, and then backfilling the hole that remains with suitable materials such as but not limited to earth, soil, aggregate, rock, or combinations thereof.

Some embodiments of the present disclosure may include a step of actuating the wedge assembly 50 before the step of cutting 210 so that the at least one bearing member 26 bears against an inner surface of the tubular 102 to stabilize the cutting tool 10, 300, 400. When the step of cutting 210 is completed or if the cutting tool 10, 300, 400 is to be moved, then the wedge assembly 50 can be actuated again to retract the at least one bearing member 26 from the inner surface of the tubular 102.

I claim:

1. A cutter tool for cutting a tubular comprising:

(a) a housing that is insertable into and within the tubular;

(b) a cutting member housed within the housing, the cutting member having a first end and a second end, said first end comprising a cutting element;

(c) a first shaft having a first shaft-end and a second shaft-end, said first shaft-end connectible to the housing such that rotating the first shaft causes the housing and the cutting member to rotate; and (d) a second shaft that is operatively couplable with the second end of the cutting member, wherein the cutting member is moveable between a retracted position within the housing and a cutting position extended outward from the housing, wherein the cutting member is moved by rotating the second shaft in a first direction thereby extending the cutting element out of the housing or a second direction thereby retracting the cutting element into and within the housing.

2. The cutter tool of claim 1 wherein the cutting element comprises a cutting edge and a flexible body that comprises a first body end and a second body end, wherein the first body end is pivotally connectible to the cutting element and the second body end is connectible to the second shaft.

3. The cutter tool of claim 2 wherein the cutting element is releasably connectible to the flexible body.

4. The cutter tool of claim 2 wherein the flexible body comprises two or more links that are each pivotally connectible by a pivot pin.

5. The cutter tool of claim 1 wherein the first shaft-end is releasably connectible to the housing.

6. The cutter tool of claim 1 wherein the second shaft is releasably connectible to the cutting member.

7. The cutter tool of claim 1 wherein the housing defines an internal chamber and the cutting member is received therein for slidingly moving between the retracted position and the cutting position extended outward from the housing.

8. The cutter tool of claim 1, further comprising a centralizer that is positionable above the housing for stabilizing the housing at a centralized position within the tubular.

9. The cutter tool of claim 1 wherein the cutting member comprises a cutting wheel housed within a cutting-wheel mount wherein the cutting-wheel mount is cooperable with the second shaft.

10. The cutter tool of claim 9, wherein the second shaft comprises a first end and a second end, the first end coupled with a keyway body that houses the cutting wheel mount, and when the second shaft is rotated in the first direction, the first end moves the keyway body and the cutting-wheel mount towards the extended position.

11. The cutter tool of claim 9, wherein the second shaft comprises a first end and a second end, the first end operatively coupled to the cutting-wheel mount by a first cam member and a second cam member, wherein the first cam member is connected to the first end and the second cam member houses the wheel-cutting mount, and wherein when the second shaft is rotated in the first direction, first cam surface of the first cam member slides along a second cam surface of the second cam member thereby moving the cutting wheel mount towards the extended position.

12. The cutter tool of claim 11, further comprising a biasing member positioned between the housing and the second cam member, the biasing member for biasing the second cam member towards the retracted position.

13. A method of plugging and cutting a tubular, the method comprising steps of:

(a) inserting and setting a plug at a predetermined depth within the tubular;

(b) inserting a cutting tool into the tubular at a selected depth above the plug, wherein the cutting tool comprises a housing and a cutting member that is moveable between a retracted position within the housing and an extended-outward and cutting position wherein the cutting member is at least partially outside of the housing;

(c) rotating a second shaft of the cutting tool in a first direction to move the cutting member into the extended-outward and cutting position to engage an uncut portion of the tubular;

(d) rotating a first shaft of the cutting tool for cutting the tubular; and (e) moving the cutting member into the retracted position within the housing and removing the cutting tool from the tubular.

14. The method of claim 13, wherein the step (c) of rotating the second shaft occurs before, after or during the step (d) of rotating the first shaft.

15. The method of claim 13, wherein the step (c) of rotating the second shaft further comprises rotating the second shaft in the first direction and wherein the step (e) of moving the cutting member into the retracted position within the housing comprises a step of rotating the second shaft in a second direction, wherein the second direction is opposite to the first direction.

* * * * *